US006554134B1

(12) United States Patent
Guibert

(10) Patent No.: US 6,554,134 B1
(45) Date of Patent: Apr. 29, 2003

(54) CASE FOR PRODUCTS SUCH AS MOIST WIPES

(76) Inventor: Denis Guibert, 7, rue de la Gallardon, F-28130 Chartainvilliers (FR)

( * ) Notice: Subject to any disclaimer, the term of this patent is extended or adjusted under 35 U.S.C. 154(b) by 0 days.

(21) Appl. No.: 09/581,092

(22) PCT Filed: Dec. 10, 1998

(86) PCT No.: PCT/FR98/02693

§ 371 (c)(1),
(2), (4) Date: Jul. 25, 2000

(87) PCT Pub. No.: WO99/29589

PCT Pub. Date: Jun. 17, 1999

(30) Foreign Application Priority Data

Dec. 10, 1997 (FR) ..... 97 15656
Oct. 7, 1998 (FR) ..... 98 12571

(51) Int. Cl.[7] ..... B65D 73/00
(52) U.S. Cl. ..... 206/494; 383/211
(58) Field of Search ..... 206/205, 449, 206/494, 812; 383/203, 208, 211; 211/47; 428/126, 130

(56) References Cited

U.S. PATENT DOCUMENTS 4,156,493 A 5/1979 Julius
4,192,420 A * 3/1980 Worrell et al. ..... 206/205
4,210,247 A * 7/1980 Frye et al. ..... 206/494
4,552,269 A * 11/1985 Chang ..... 383/211
4,610,357 A * 9/1986 Nakamura ..... 206/494
4,679,693 A * 7/1987 Forman ..... 383/211
4,706,844 A 11/1987 Omdoll et al.
4,723,301 A * 2/1988 Chang ..... 383/211
5,595,300 A 1/1997 Paik et al.
5,642,810 A 7/1997 Warner et al.
5,853,845 A * 12/1998 McConnell et al. ..... 206/494
6,309,105 B1 * 10/2001 Palumbo ..... 206/494

FOREIGN PATENT DOCUMENTS

| | | |
|---|---|---|
| EP | 119 314 | 9/1984 |
| EP | 447 636 | 9/1991 |
| EP | 475 463 | 3/1992 |
| WO | WO 91/04920 | 4/1991 |

* cited by examiner

*Primary Examiner*—Luan K. Bui
(74) *Attorney, Agent, or Firm*—Bachman & LaPointe, P.C.

(57) ABSTRACT

The invention concerns a case which is opened along a break-off line by pulling on a label capable of being stuck back. The break-off line extends up to the edge of the case front wall. Each item has on its front surface a prehensile corner located in the pile median zone. The prehensile corner of the item located at the top of the pile is positioned opposite the dispensing aperture. The invention is applicable to cases for moist wipes.

2 Claims, 10 Drawing Sheets

Fig.2
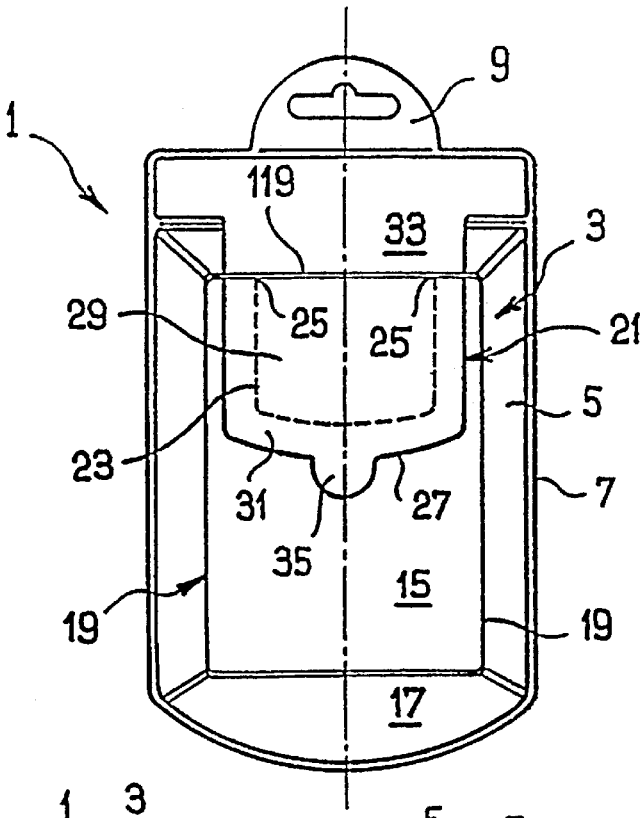
Fig.4
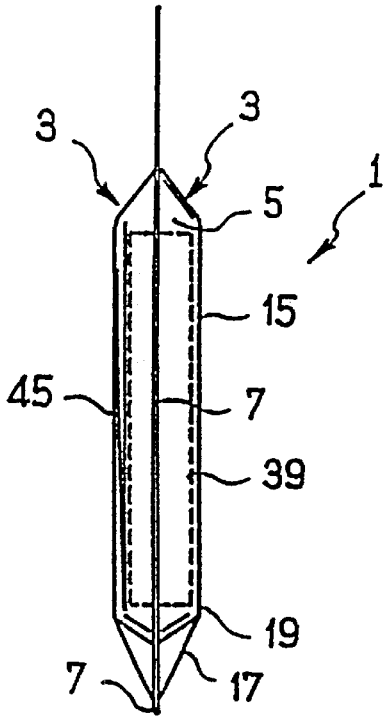
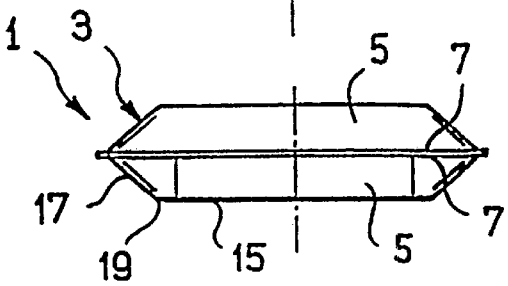
Fig.3

CASE FOR PRODUCTS SUCH AS MOIST WIPES

BACKGROUND OF THE INVENTION

The present invention relates to a case, and in particular a case intended to contain and distribute products, for example products presented more or less in the form of a folded sheet, arranged in a pile inside said case.

It is also intended for an article constituting a case containing such products.

In the prior art there were cases for hygiene products made with a film or leaf of flexible plastic material enveloping the products. These cases have a median longitudinal joint along one of their major faces and a joint along each of the two edges perpendicular to the longitudinal joint.

More or less in the middle of the other major face, these cases have an opening device comprising a break-off line, for example a line already cut out, not rectilinear, and an adhesive label. Generally the label covers the zone defined inside the break-off line, and extends slightly outside said zone.

When the case is used for the first time, the label is separated from the corresponding wall. The label is unstuck from the region of the wall situated outside the break-off line and brings with it the region of the wall located inside the break-off line. This region detaches from the rest of the wall along the break-off line and then forms a closing and opening cap of a dispensing aperture. The case is re-closed, by sticking the label back in its initial position, the cap returning more or less into place in the dispensing aperture.

Patent WO96/11147 describes such a case intended to contain hygiene products arranged in piles. The objective is to reduce the surface of the adhesive label, in order to economise adhesive material. It presents a break-off line in a V shape or in the shape of part of a circle, and a label whose shape is more or less analogous, which only covers the break-off line and the lateral edges on either side of it.

In the present state of the art as in the prior art the cases have a certain number of inconveniences in common. The most important are discussed below.

In general, the opening device is placed more or less in the middle of one of their faces. It is often difficult to grip the product appearing on the top of the pile through the dispensing aperture. There is also the risk of taking out at least two products at once instead of one.

In the present state of the art the cases generally have a longitudinal joint along one of their faces, like many food packages. This joint is not aesthetic and gives the case a utilitarian appearance, unsuited to luxury products in particular, for example, wipes impregnated with prestigious perfumes.

In the previous state of the art the cases were made out of a flexible material which did not have the solidity required for certain uses, and there was a risk, for example, of tearing, particularly if the user pulled the label further than that planned by the designer of the case. The label then risked being pulled off completely and could be very difficult to re-stick completely and/or tightly.

In the previous state of the art there was also a case which could be re-closed, described in patent WO91/04920. This case was intended to improve previous cases with a hole in the front face, to allow the extraction of a handkerchief, or to replace cases with a break-off line extending as far as a sealing strip. This document proposed replacing this median hole or the shutter limited by the cut-out line and the sealing strip by an opening limited by a cut-out line extending as far as the upper edge.

This solution is not satisfactory, since the traction exerted by the flap can cause a tear along the fold forming the upper edge, especially when the traction comprises a component parallel to the fold. There is then a loss of tightness. Moreover, the upper edge of the wipes is accessible when the case is open, which can lead the user to take out the wipe not by seizing it by the median fold but by seizing it by the upper edge. This poor manipulation leads to defective hygiene and a risk of extracting several wipes. Moreover, the flap can position itself in an inclined way, which decreases the tightness of the packaging.

SUMMARY OF THE INVENTION

The aim of the present invention is to propose a product case to remedy at least some of the inconveniences of the previous state of the art.

According to a first feature of the invention, the case comprises sealing means and an opening device set on one face of the case and formed by an adhesive label and an opening cap surrounded at least partly by a break-off line. The adhesive label entirely covers the opening caps and extends beyond the break-off line which extends to the vicinity of a stop edge of the said face. The break-off line extends to the vicinity of the upper edge, without actually reaching it. The idea of vicinity depends on the size and dimension of the case. It can be considered, within the meaning of the present patent, as a distance which is lower by several percent, in particular less than 10%, of the dimension parallel to the traction axis.

The notion of "without coming into contact" is to be understood as keeping a small distance, for example less than several thousandths, in particular less than 1%, of the dimension parallel to the traction axis.

This solution makes it possible to avoid tearing the case in the event of excessive traction on the closing cap. Moreover, it keeps an upper zone in which the packaged article remains held, contrary to solutions comprising a sealing strip.

The result obtained is greater tightness and a re-closable opening which avoids the item being caught by the side. They can only be seized by the median corner.

The break-off line defines the contour of a dispensing aperture, which is situated in such a way as to overlap preferably one edge of the first item to be distributed.

Thus the user can, with one finger, select the first item appearing before taking it out easily, pulling on the central corner. Difficulties and wastage during use are thus avoided.

The zone extending between the extremities of the break-off line and the side of the case has the function of stopping the movement resulting from the traction on the label. It can be a zone belonging to the external contour of the case, or a zone formed within the external contour.

The break-off line preferably presents two extremities going more or less to the stop edge and between which the material of the case forms an articulation line for the cap.

In the different embodiments described hereinafter the face with the break-off line will be called the front face. The opposite face will be called the rear face.

According to a first embodiment of the invention, the case is made of plastic material, for example thermoformed or injected, and presents a shell forming the rear face of the case and inter-linked with a closure element by joining their respective free edges. The said closure element can be constituted of a flexible membrane, but advantageously takes the form of a second shell forming the front face of the case. In the latter case, before being joined, the two shells can be:

independent and thus joined later by their four free edges, or thermoformed on the same sheet of plastic in such a way as to be joined by one part of this sheet making a hinge. The two shells are then joined by their three remaining free edges.

In this first embodiment, the stop edge can be an edge common to two faces of one of the shells.

According to this embodiment, the case of the invention can advantageously comprise a tongue placed in a plane parallel to that formed by the two shells. This tongue is useful for handling the case. It can also act as support for a possible hollow body.

According to this same embodiment the case can furthermore comprise means of pushing, intended to facilitate the exit of the items contained in the said case. These different elements will be described in detail further on in the description.

According to a second embodiment of the invention, the case is made from a sheet of flexible and impermeable material, for example plastic material, folded in two along a fold line in such a way as to form two more or less parallel parts. These two parts are joined together by their respective free edges.

In a first variant of the second embodiment of the invention, the break-off line is situated in the vicinity of the fold line. Preferably, the stop edge is constituted by the fold line. According to this variant, the adhesive label can be arranged in such a way as to overlap the fold line. This arrangement has the advantage of providing a label with a very high traction resistance.

In another variant of the second embodiment of the invention, the fold line is located on the edge opposite the break-off line. The adhesive label can then be placed in such a way that one edge of the label is adjacent to the edge of the case opposite the fold line; this arrangement has the advantage of being economical since it needs little adhesive material.

The label can also be formed by a return of the back part of the case onto the front part. This return overlaps the break-off line in such a way as to cover the cap. This return is possibly inter-linked by joining it to the edge neighbouring the break-off line. In addition, it is made adhesive after coating with an adhesive polymer or any other material possessing the required adhesive properties.

In a final embodiment of the present invention, the case is made from two pieces of plastic material placed in parallel planes, these two parts being joined together by their four respective free edges.

In this embodiment, the adhesive label is arranged in such a way as to overlap the edge of the case adjacent to it.

According to any one of these embodiments, the adhesive label can if needed be linked to the case by joining it, for example, to the lateral edge adjacent to it. Nonetheless any other adequate means of linkage can be envisaged.

Thus according to one or the other of the embodiments, the case has two opposite parts, joined together by lateral edges, and whose long faces are not crossed by any joining line. They remain available, for example, to receive a decorative motif or a message of the advertising type.

Traditionally, hygiene products arranged in a pile inside the case are each folded in a certain number of elementary rectangles and/or squares one of which constitutes a face of the folded item turned towards the dispensing aperture.

According to one feature of the invention, the article comprising products, especially paper products particularly in the form of a sheet such as, for example, wipes or handkerchiefs, arranged in a pile inside the distributor case with a dispensing aperture in one of -its faces, is characterised in that each product presents on one face turned towards the dispensing aperture, a prehensile corner situated in the median zone of its front item to be distributed is positioned in front of the dispensing aperture of the case.

Advantageously, the prehensile corners located on the products can have a boarder whose colour differs from that of the hygiene products.

The user can thus tell at a glance the precise place where he should take hold of the product.

BRIEF DESCRIPTION OF THE DRAWINGS

Other particularities and advantages of the invention will be found in the following description of the two embodiments given as a non-restrictive example. In the appended drawings:

FIGS. 2, 3 and 4 represent, respectively, views of the hygiene article of FIG. 1 from above, from in front and from the side, FIG. 4 represents an article comprising a case according to the first embodiment comprising a possibly hollow body;

DETAILED DESCRIPTION OF THE PREFERRED EMBODIMENT(S)

Figure 1:
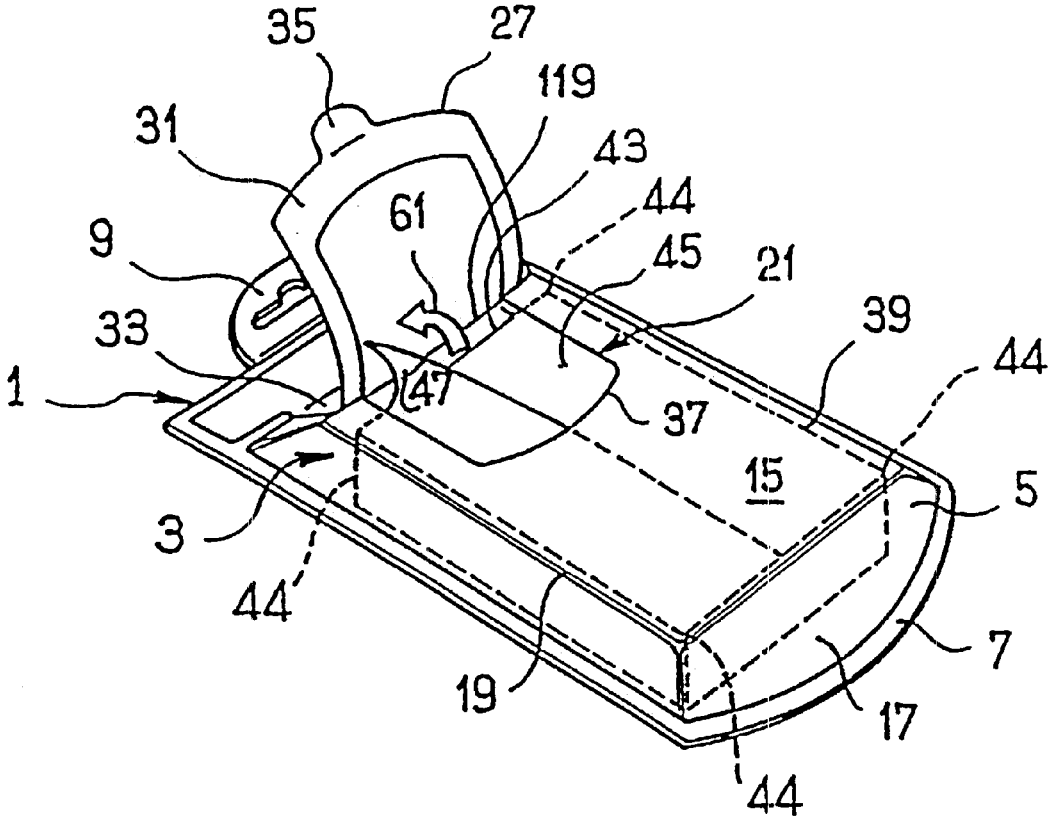
FIG. 1 represents in perspective a hygiene article comprising a case according to the first embodiment of the invention and an arrangement of hygiene products in this case.

In the embodiment represented in FIGS. 1 to 4, case 1 is produced in semi-rigid thermoformed plastic material and comprises two complementary shells 3 of the same shape and the same dimensions, each formed with a body more or less the shape of a truncated pyramid with an open rectangular base surrounded by a lateral edge 7.

The two shells 3 are arranged against each other, the two cavities 5 communicate with each other and the respective lateral edges 7 are joined to each other hermetically all around the two bodies.

The lateral edges 7 are preferably of small width compared with the dimensions of the cavities 5, in practice their width is as small as possible compatible with an efficient joint.

Each body has a base 15 more or less plane and a lateral wall 17 which links the base 15 and the lateral edge 7. The base 15 is separated from the adjacent lateral wall 17 by four ridges extending according to the contour 19 of the base 15, obtained during thermoforming.

The base 15 of one of the shells 3, called "front", comprises an opening device 21. The device comprises a break-off line 23 made in the base 15 of the shell 3, for example a pre-cut line, which is not rectilinear nor closed, and whose two extremities 25 rejoin the contour 19 in a single ridge 119 forming a stop edge as explained below.

The opening device 21 also comprises an adhesive label 27 arranged on the outside of the shell 3. The label 27 completely covers a cap 29 defined by the break-off line 23 and the part of the stop edge 119 located between the extremities 25 of the break-off line 23 forming the articulation line of the cap. Besides, the label extends beyond the cap 29, on the one hand on the base 15 leaving an overlapping zone 31 all around the break-off line 23, and on the other hand beyond the stop edge 119 leaving a fixation zone 33 on the lateral wall 17.

Opposite the fixation zone 33, the adhesive label 27 is provided with a tab 35, locally prolonging the overlapping zone 31. The tab 35 does not have an adhesive coating.

At the time when the case is first used, the user takes the tab 35 between two fingers and lifts it in the direction of the fixation zone 33.

The overlapping zone 31 of the adhesive label 27 unsticks from the base 15, while the cap 29 is cut out gradually along the break-off line 23. The cap 29 remains stuck to the adhesive label 27 and allows a dispensing aperture 37 to appear through the base 15.

The break-off procedure from the base 15 stops automatically when it reaches ridge 119 at the extremities 25 of the break-off line 23 because:

- there is no break-off line on the lateral wall 17 to guide the break-off,
- the ridge 119, separating the plane of the base 15 and the plane of the adjacent face of the lateral wall 17, then forms a stop edge for unsticking the adhesive label 27 and for the break-off of the base 15, since the traction exercised by the user on the tab 35 is not oriented in the direction of tearing, compared to the lateral wall 17,
- the same stop edge 119 constitutes, as already explained, a natural articulation line (FIG. 1) between the cap 29 separated from the base and the lateral wall 17.

If the extremities 25 of the break-off line 23 did not extend almost to the contour 19, there would be a risk of prolonging the cut-out beyond said extremities 25, in an irregular fashion, and in tearing form, until said tear meets said contour 19. The tear, once started, could be prolonged even further. This is why it is preferable for the break-off line 23 to be next to a stop edge such as 119.

In order to reclose the case 1, the user proceeds in the reverse order from opening: he or she resets the cap 29 on the dispensing aperture 37 and reapplies the overlapping zone 31 of the adhesive label 27 on the base 15. The adhesive label 27 is provided with an adhesive coating which enables it to unstick and restick several times, each time re-establishing tightness.

The case 1 must be air- and water-tight, to avoid any evaporation of the liquid impregnating the hygiene products 41 when it concerns humid wipes. In order to obtain this, case 1 comprises tightness means, among them the adhesive label 27, the joining lines 8, and the articulation line formed by part of the ridge 119.

In the example shown, the lateral edges 7 can locally have a greater width, for example for a tab 9 for handling the case and hooking it onto a sales display unit.

In a special form of embodiment according to the first embodiment of the invention, the case comprises on its tab 9 the means for securing the case on a support. An example of a means of securing consists of a body, possibly hollow, whose rear face carries adhesive material. This possibly hollow body has a depth at least equal to the depth of the rear shell of the case 1. In the case where the body is hollow, it is able to contain a perfumed compound or any other equivalent product.

The means for securing on a support can be articulated to the case by any appropriate means such as a hinge. This articulation provides relative freedom of movement between the case 1 and the means of securing on a support. Thus, when the case 1 is secured on a support, for example the dashboard of a car, by the rear face through securing means, thanks to the hinge it benefits from a certain freedom of movement. This property allows, especially, easier handling of the case of the invention.

As FIGS. 1 and 4 show, the hygiene article also comprises a pile 39 of hygiene products 41 folded and piled up according to a parallelepiped in the space inside the case 1.

The dispensing aperture 37 of the opening device 21 overlaps an edge 43 of the pile 39 and in particular the first item to be distributed 45.

In order to avoid problems linked with displacement of the prehensile corner 47 after successive utilisation of the case 1, the latter comprises pushing means 45. These will push the pile 39 of hygiene products 41 towards the opening device 21 and thus facilitate extraction of the first item 41 to be distributed while hindering displacement of the prehensile corner 47 relative to the dispensing aperture 37.

Said pushing means 45 can comprise a spring, for example a blade spring 45, set between the pile 39 of products 41 and the base 15 of the shell 3 which has no dispensing aperture, and is represented in side view under the form of a V in FIG. 4.

Nevertheless, the pushing means 45 can also be formed by the back face of the case. For this it suffices for the latter to have a concavity 4, maximum at rest, that is to say when the case is empty. When the pile of wipes is set in place in the case, the wipes rest against the concavity 4. Progressively, as the wipes are removed, the concavity 4 exerts a pressure, thus acting as a means of pushing on the wipes.

The hygiene products 41 are folded in such a manner as to show a prehensile corner 47 on their front face 49 along the edge 43 which is overlapped by the dispensing aperture and at a distance from the angles 44 of the pile.

The dispensing aperture 37 discloses the prehensile corner 47 of the first hygiene product 41 to be distributed when the cap 29 is lifted.

Figure 5:
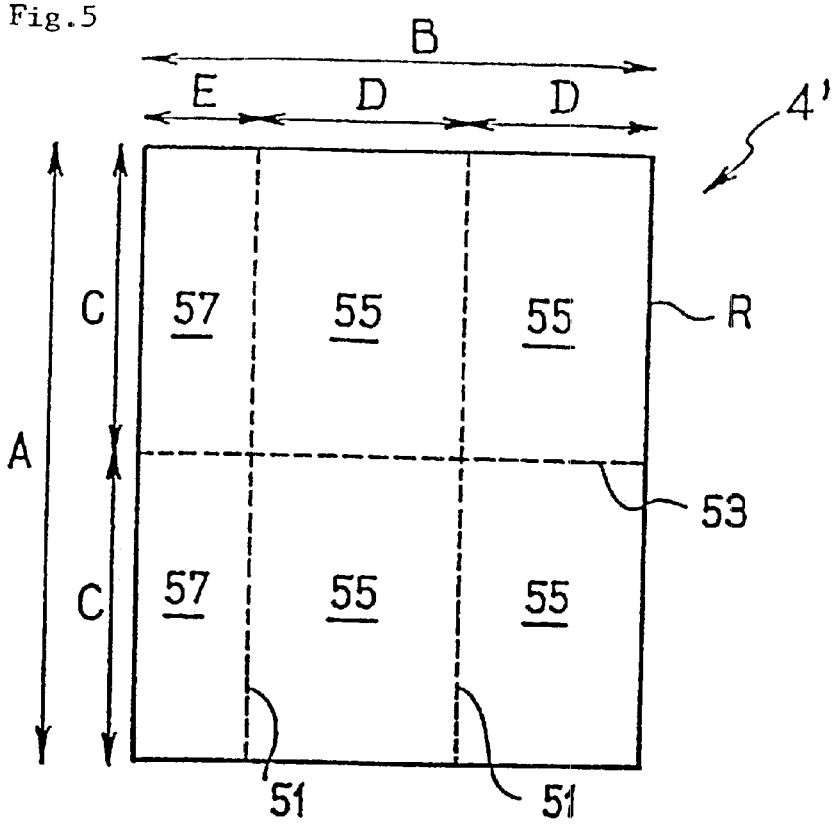
FIG. 5 illustrates the dividing lines for a first method of folding a hygiene product.
Figure 6:
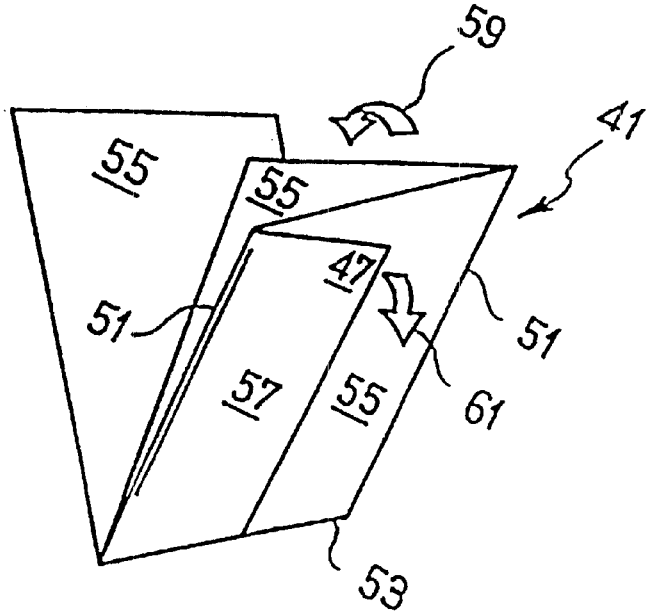
FIG. 6 illustrates the first method of folding a hygiene product.

Below is defined a first method of folding a hygiene product 41 which produces a prehensile corner 47 on the face of said product, as illustrated in FIGS. 5 and 6.

FIG. 5 represents an item 41 in unfolded configuration under the form of a rectangle R of length A and width B. The dividing lines 51 are dotted, parallel to the edges of length A and dividing lines 53 parallel to the edges of width B.

These dividing lines 51, 53 divide the rectangle R into elementary rectangles 55, 57.

In the example shown, there is a single dividing line 53 defining two rows of elementary rectangles 55, 57 all with the same elementary length C which defines the greatest dimension of the item 41 folded parallel to the length A of the unfolded product. On the other hand there are two dividing lines 51 which define two adjacent columns of elementary rectangles 55, all with an elementary width D, and a column of elementary rectangles 57 with an elementary width E smaller than the elementary width D.

The elementary width D defines the smallest dimension of the item 41 when folded, parallel to the stop edge 119 in the case.

Preferably the width D is close to double the width E. The column Of elementary rectangles 57 which have the smallest width E is adjacent to one edge of the rectangle R.

The folding of the item 41 is illustrated in FIG. 6. It comprises the following stages:

the rectangle R is pleated following the two dividing lines 51, forming three sections, two of them with width D and the third with width E.

next the pleating is folded along the dividing line 53 as indicated by the arrow 59.

Thus the two elementary rectangles 55 of width D are put into contact, and the elementary rectangles 57 of width E are oriented towards the exterior.

In this way one obtains a prehensile corner 47 located in the median zone of one of the edges of the item 41, said prehensile corner 47 being able to be separated easily from the subjacent elementary rectangle 55 by a movement illustrated by the arrow 61 in FIGS. 6 and 1.

When a pile 39 of folded hygiene products 41 is formed as described above, one has to be careful that each item shows a prehensile corner 47 along the same edge of the pile, orienting them all the same way or, for example, in one direction or the other alternately.

When the pile is placed in the case, this edge should extend along the stop edge 119 of the case.

This method of folding is particularly adapted to the cases defining an interior space which is close to a parallelepiped, and whose dispensing aperture 37 is arranged along a small side of the case, as for the case shown in FIGS. 1 to 4.

Figure 7:
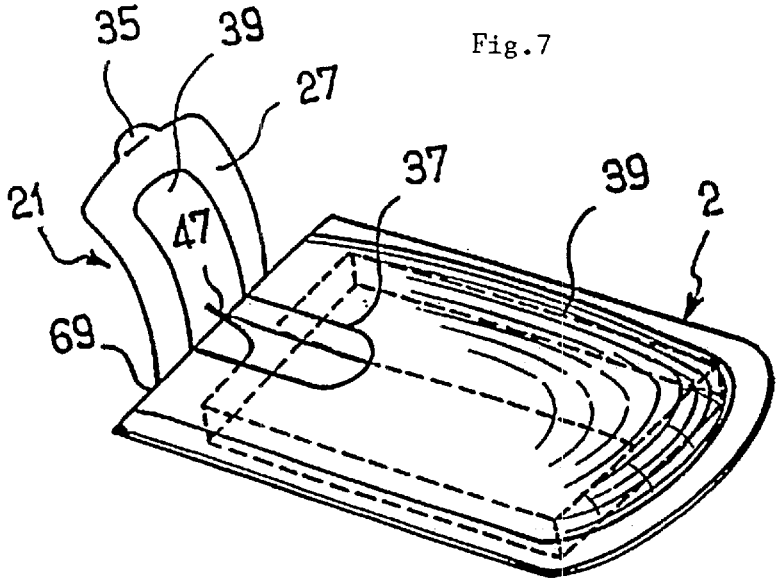
FIG. 7 is analogous to FIG. 1, but for a hygiene article whose case corresponds to a second embodiment of the invention.
Figure 8:
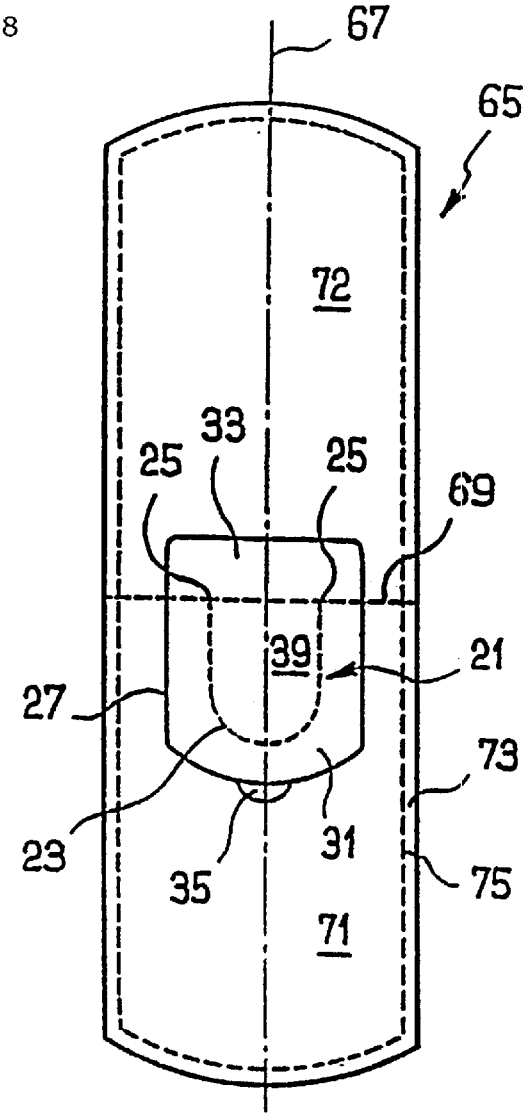
FIG. 8 represents a view from above and in unfolded form of the case of the hygiene article of FIG. 7.

FIGS. 7 and 8 illustrate a second embodiment of the case 1, also able to receive hygiene products folded according to the first folding method, and will not be described except for its differences from the first embodiment.

This time case 2 is produced from a piece 65 cut out from a sheet of flexible plastic material.

Piece 65 has a symmetrical longitudinal axis 67 and a folding line 69 perpendicular to the symmetrical axis 67 and dividing the piece 65 into two parts 71 and 72, with external contours more or less symmetrical compared to the folding line. Along this contour they have a lateral wall 73 whose internal contour is illustrated in FIG. 8 by a dotted line 75.

Case 2 is produced by folding piece 65 along the folding line 69 and joining the respective lateral edges 73 of the two parts 71, 72 to each other. The case is closed hermetically around its perimeter by the folding and the joint.

The break-off line 23 is located on one of the parts 71.

In a first variant of this embodiment, the extremities 25 of the line 23 extend up to the folding line 69.

The adhesive label 27 covers the cap 39 and overlaps all around it on the corresponding part 71 of the case 2, and either beyond the folding line 69 onto the other part 72 of the case 2 or placed in such a way that the edge of the label 27 is adjacent to the folding line 69.

In a second variant of this embodiment, the folding line 69 is located on the edge of the part 71 opposite the break-off line 23. The label 27 is then formed by a return of the rear part 72 of the case over the front part 71. This return overlaps the break-off line 23 in such a way as to cover the opening cap 37. This return is made adhesive by coating with an adhesive polymer. For this, it is particularly advantageous to use an adhesive whose polymerisation can be temperature controlled. Those skilled in the art alone can determine at which production stage of the case it is suitable to give the polymer its adhesive properties.

When the case 2 is used for the first time, the part 71 is cut out along the break-off line 23, revealing a dispensing aperture 37 (FIG. 7). The cut-out process ends on its own on the folding line 69, which constitutes a stop edge.

The sealing means of the case 2 comprise the nature of the material constituting the case; the adhesive label 27, the joining line 74 and the folding line 69.

Another embodiment of case 2, equally able to receive hygiene products folded according to the first folding method, and which will not be described apart from its differences from the embodiment of case 2 as explained above.

This time the case 2 is produced from two pieces 65 cut out of a sheet of flexible plastic material. The pieces 65 are placed in parallel planes and form two parts 71, 72 more or less parallel. The two parts 71, 72 are joined together by their four respective free edges 73.

In this embodiment, the adhesive label 27 is arranged in such a way as to overlap the edge of the case which is adjacent to it.

FIG. 7 illustrates the arrangement of the pile 39 of hygiene products 41 inside the case 2. It is to be noted that with the case according to this embodiment, contrary to the flexible cases of the previous state of the art, the hygiene products can be arranged in the case by filling it and not by enveloping a pile of products with a sheet of plastic.

In particular, the case can be prepared by folding along the fold line, and then joining part of the lateral edges, before filling the pouch thus formed with the pile of products, and joining the final part of the lateral edges.

Figure 9:
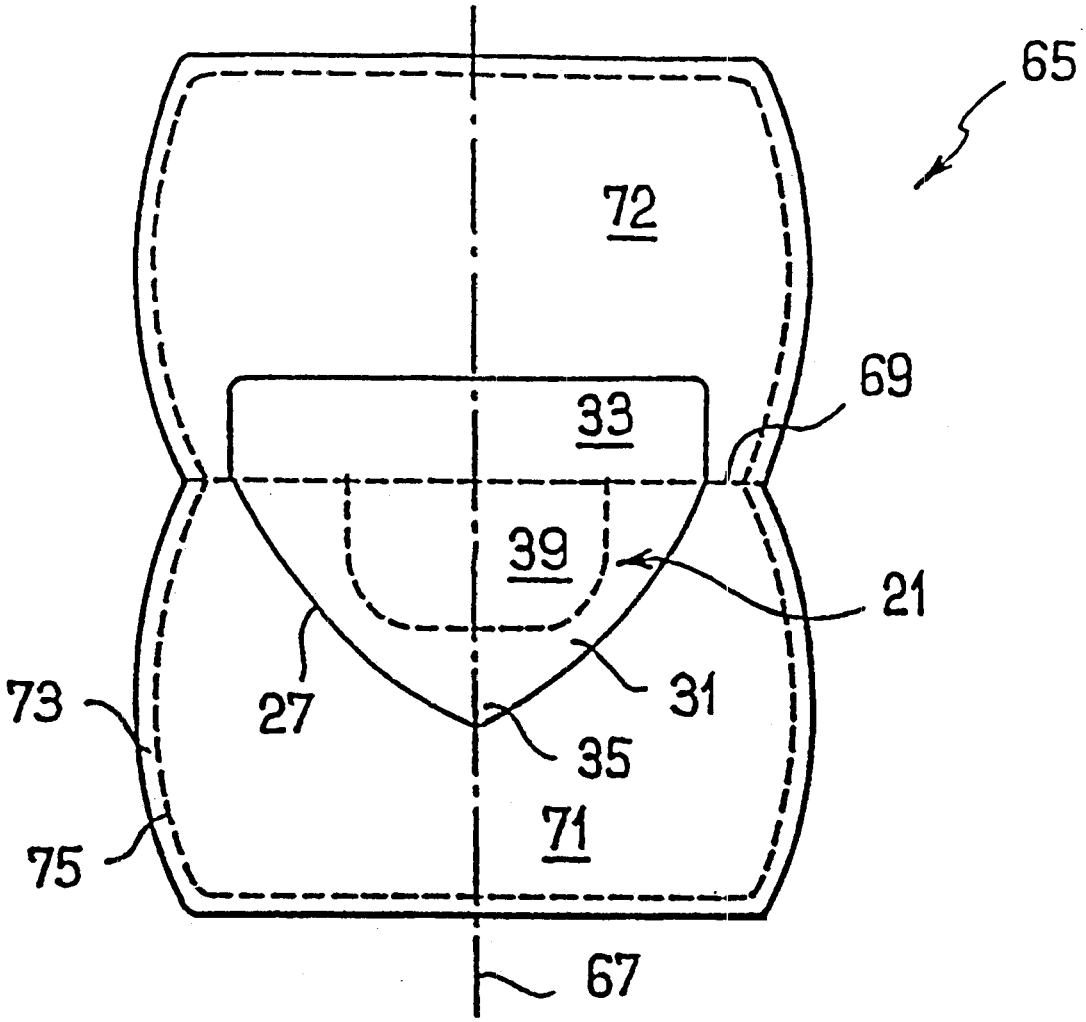
FIG. 9 is analogous to FIG. 8 for productive variants.

A variant of the second embodiment of producing the case 2 is illustrated in FIG. 9.

This time, the dispensing aperture 37 is arranged along a long side of the case 2. This variant corresponds to a second method of folding the hygiene products 41 which will be described by referring to FIGS. 10 and 11.

Figure 10:
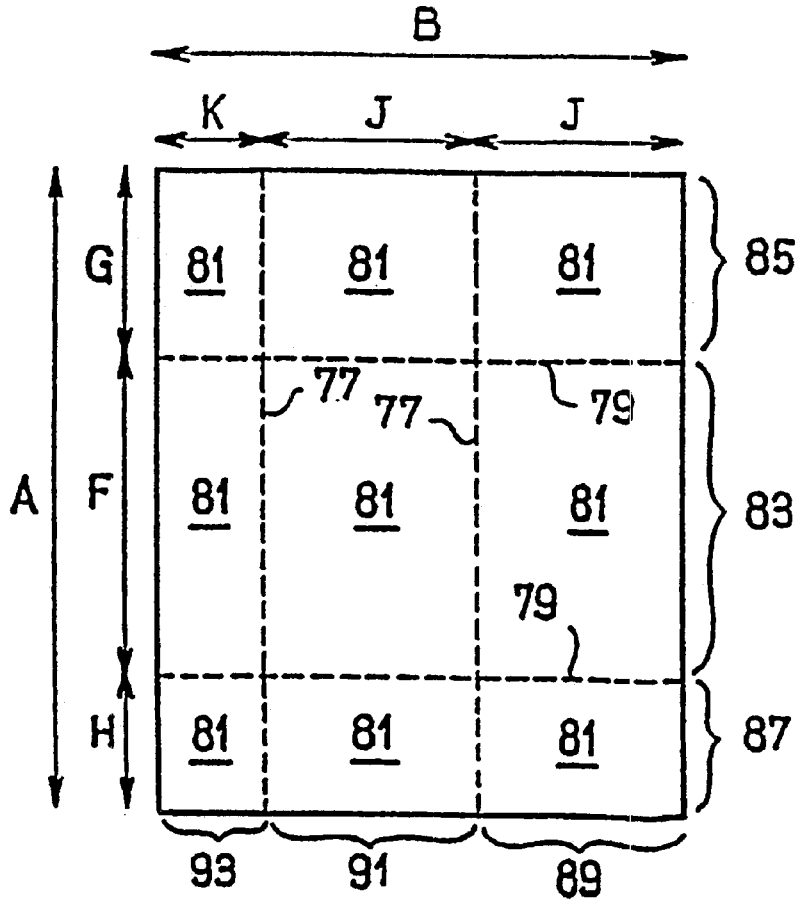
FIGS. 10 and 11 are analogous to FIGS. 5 and 6 for a second mode of folding.

FIG. 10 represents an item 41 in unfolded configuration in the form of a rectangle R of length A and width B. The dotted lines show the dividing lines 77 parallel to the edges of length A and the dividing lines 79 parallel to the edges of width B.

These dividing lines 77, 79, divide the rectangle R into elementary rectangles 81.

In the example given, there are two dividing lines 77 which define three rows 83, 85, 87 and two dividing lines 79 which define three columns 89, 91, 93 of elementary rectangles 81.

The central row 83 has an elementary length F, which defines the biggest dimension of the folded item 41. The rows 85, 87 present elementary lengths G, H, respectively, both smaller than the elementary length F. Preferably, the elementary lengths G and H are complementary so that their sum G+H is more or less equal to the elementary length F.

The adjacent columns 89 and 91 both present an elementary width J which defines the smallest dimension of item 41 folded. Column 93 has an elementary width K reduced compared to J. This column 93 is adjacent to an edge of the rectangle R.

Figure 11:
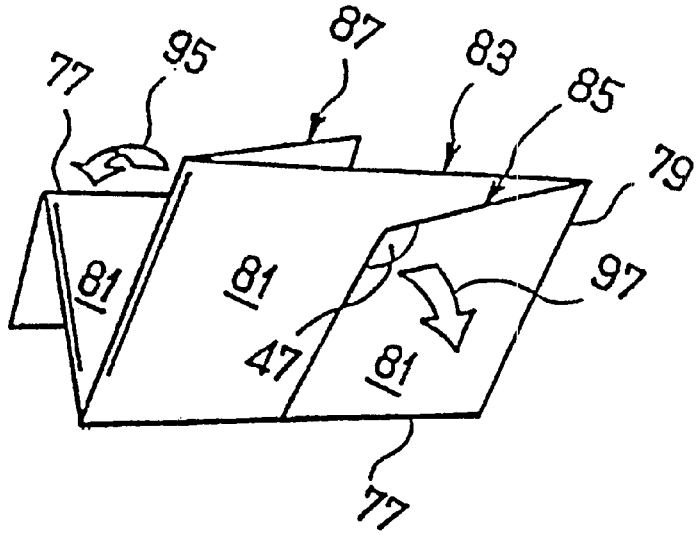

The folding of the product 41 is illustrated in FIG. 11. It comprises the following stages:

rectangle R is pleated following the dividing lines 79, forming three sections of respective widths G, F, H; the two opposite faces of the pleating are of reduced width starting from the two opposite lateral edges;

next, the pleats are folded along the dividing lines 79, for example still pleated, as illustrated by arrow 95 of FIG. 11.

The front face of the product is considered to be that where the elementary rectangles are the biggest.

Thus a prehensile corner 47 is obtained located in the median zone of an edge of the front face of the product 41, said prehensile corner being easily separated from the subjacent elementary rectangle 81 by a movement illustrated by arrow 97 in FIG. 11.

An advantageous embodiment is described in reference to FIGS. 12 to 15.

Figure 12:
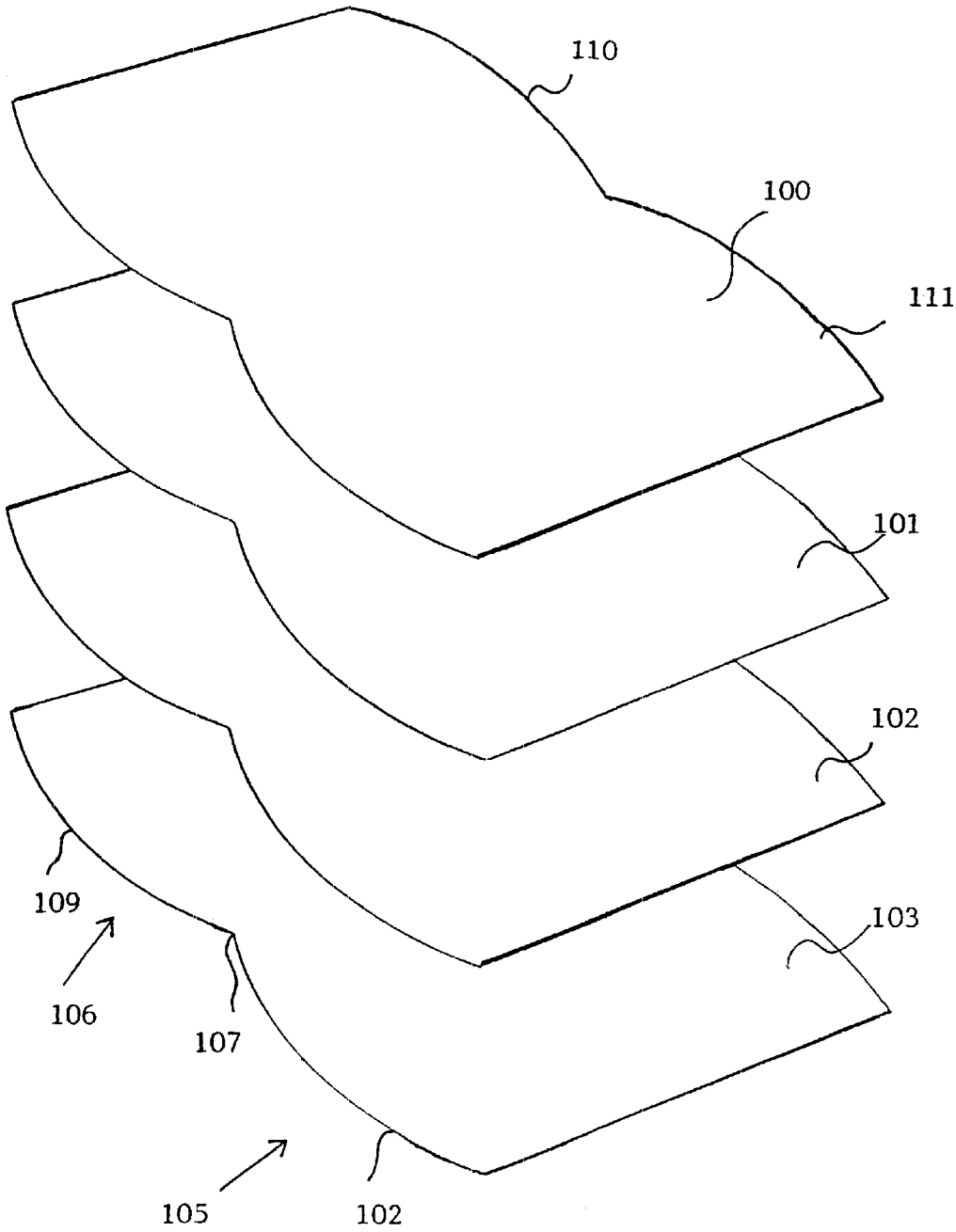
FIG. 12 is a diagram of a complex film for producing a variant of the invention.

The case can be produced by folding and lateral sealing of a complex film formed, as shown in FIG. 12, by:

a layer 100 of an adhesive material, in particular a heat-reactive adhesive on its external face and cold-reactive on the surface in contact with the film of plastic material 101;

a layer 101 formed by a plastic material such as PET;

a barrier layer 102 formed by a sheet of aluminium;

an external layer 103 formed by a plastic material such as polyethylene.

This complex is cut out to form two lobes, 105, 106, joining together in a median line 107. The lobes, 105 and 106, are in general rectangular in shape, and advantageously the lateral edges 108, 109, 110, 111, are convex.

Figure 13:
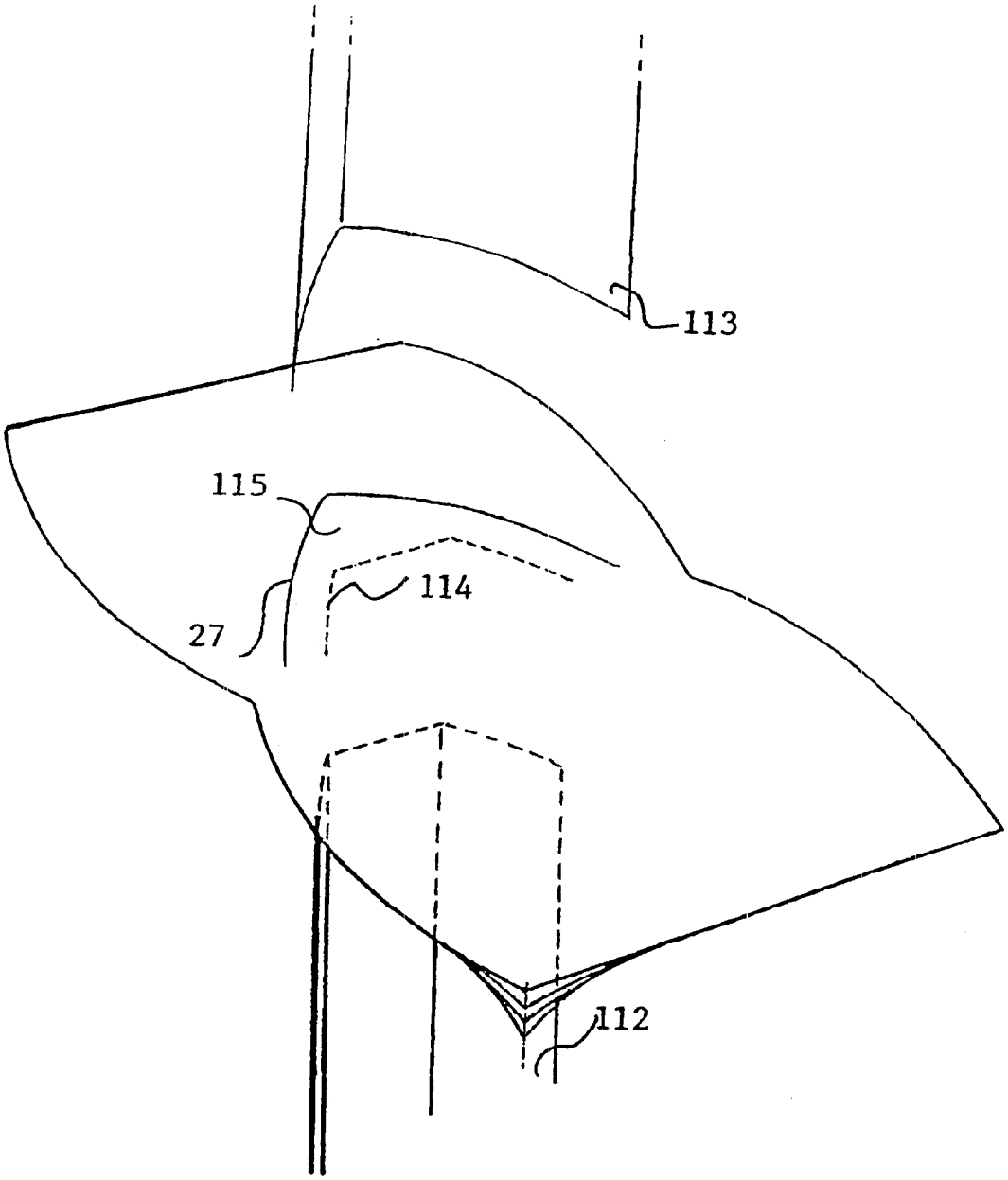
FIG. 13 represents the film during preparation.

The complex film is then prepared using a grooving matrix as shown in FIG. 13. A first cutter, 112, cuts out the complex film half-way to cut out the adhesive layer 100 completely, along a line 114 corresponding to the edge of the access aperture to the wipes. This cut-out can be made with a cutting tool with matrices equipped with steel cutting blades On the other face, the polyethylene side, a second cutter 113 makes a partial cut of the three others, 101 to 103, according to the break-off line 23.

The point 115 can be deactivated to inhibit adhesion, by treating this zone to lower the qualities of the adhesive, or by gluing a piece of a non-adhesive material.

Figure 14:
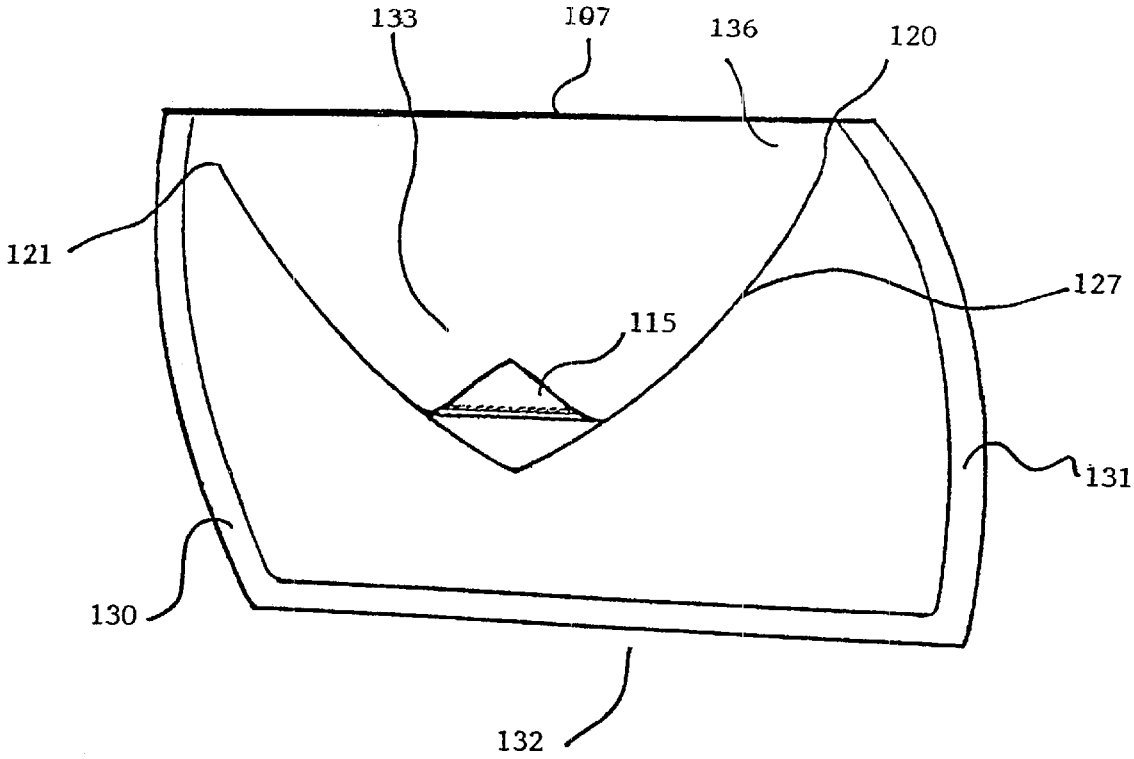
FIG. 14 represents a front view of a case produced according to this variant in closed position.

FIG. 14 represents a front view of a case produced according to this variant in a closed position. The break-off line 23 extends, at the level of its two extremities 120 and 121, up to the vicinity of the fold 107, without coming into contact with this fold. The lateral edges 130 and 131, as well as the lower edge 132 are sealed by heat-sealing or sealing of the adhesive surfaces of the two lobes, 105 and 106, of the complex film. The point 115 is de-adhesived to enable the user to seize the flap 113 easily.

Figure 15:
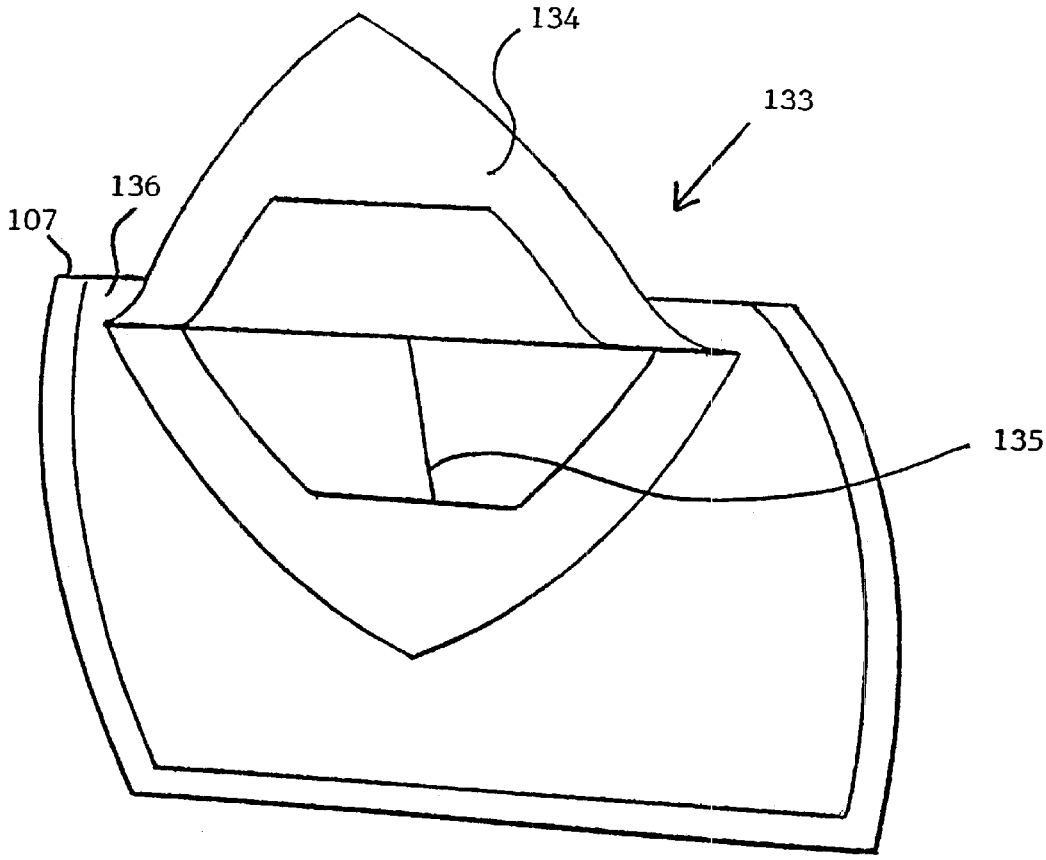
FIG. 15 represents a front view of a case produced according to this variant in open position.

FIG. 15 represents a front view of a case produced according to this variant in an open position. The flap 133 shows a wide adhesive strip, 134, which can be stuck back. The wipes appear by showing a median corner 135 allowing easy seizure, by pulling them from this corner alone. They are held in place by the upper strip 136 extending between the extremities 120, 121 of the break-off line 23, and the upper fold, 107.

Evidently, the invention is not restricted to the examples which have been described above and many variations can be added to these examples without leaving the framework of the invention.

It is possible to envisage cases of different shapes, for each of the two embodiments of the invention.

The examples which have been described concern a case for hygiene products, but it is also possible to envisage the same cases intended for other products, without leaving the framework of the invention.

It is possible to envisage that the hygiene products 41 are not rectangular in shape but, for example, square. The methods of folding described above could be applied in the same manner.

The associations described between each embodiment or production variant of the case for each method of folding are preferred but not restricted.

Each embodiment of the articles of the present invention can include a special method for incorporating products. The article which is the subject of the present invention can be provided with wipes or any other product according to procedures of the present state of the art and at different stages of production of the case.

Thus, in an illustrative but not restrictive manner, when the case composing the article is shaped from a flexible sheet, it is possible to form a first edge by bending the sheet, and then forming two other edges by joints and then filling the case thus formed through the side remaining open which will not be joined up until the case has been filled.

According to the quality of the wipes used, the impregnation can take place individually for each wipe and therefore before being placed in the cases, or grouped together at any stage whatsoever of the incorporation process.

What is claimed is:

1. An article comprising sheet products arranged in a pile, said sheet products being located inside a distributing case having means for making the case air-tight and water-tight and an opening device arranged on one face of the case, said opening device comprising an open cap prolonged by a peripheral adhesive border and surrounded at least partly by a break-off line, the break-off line being a non-closed curved line extending, at each of its extremities, to the vicinity of an edge of the case without coming into contact with said edge, said edge further having a dispensing aperture, each of said sheet products presenting on a face turned towards the dispensing aperture a prehensile corner located in a median zone of a front face, the prehensile corner of a first sheet product to be distributed being placed in front of the dispensing aperture of the case, each of said sheet products being folded and having a first pleating following a first direction in such a way that at least two rectangles of different widths are superposed and a second pleating following a second direction perpendicular to the first direction so that a rectangle of smaller width appears on the outside of the folded product.

2. an article according to claim 1, wherein each of said sheet product has on a face opposite to the smaller width rectangle, a second smaller width rectangle starting from an opposite lateral edge.

* * * * *